US008656687B2

(12) United States Patent
Pagani

(10) Patent No.: US 8,656,687 B2
(45) Date of Patent: Feb. 25, 2014

(54) PADDING MACHINE FOR PACKAGING SUBSTANTIAL PRODUCTS, PARTIALLY CUCUMBERS AND THE LIKE

(75) Inventor: Caterina Pagani, Parma (IT)

(73) Assignee: Zanichelli Meccanica S.p.A., Parma (IT)

( * ) Notice: Subject to any disclaimer, the term of this patent is extended or adjusted under 35 U.S.C. 154(b) by 424 days.

(21) Appl. No.: 13/002,959

(22) PCT Filed: May 27, 2009

(86) PCT No.: PCT/EP2009/056478

§ 371 (c)(1),
(2), (4) Date: Jan. 6, 2011

(87) PCT Pub. No.: WO2010/003731

PCT Pub. Date: Jan. 14, 2010

(65) Prior Publication Data

US 2011/0113726 A1 May 19, 2011

(30) Foreign Application Priority Data

Jul. 10, 2008 (IT) ..... MI2008A1257

(51) Int. Cl.
*B65B 25/02* (2006.01)

(52) U.S. Cl.
USPC ..... 53/276; 53/523; 53/236; 53/253

(58) Field of Classification Search
USPC ..... 53/272, 276, 471, 472, 485, 523, 527, 53/236, 253
See application file for complete search history.

(56) References Cited

U.S. PATENT DOCUMENTS

| | | | | | |
|---|---|---|---|---|---|
| 3,919,828 | A | * | 11/1975 | Zellman | 53/527 |
| 4,121,400 | A | * | 10/1978 | Sohn et al. | 53/436 |
| 4,559,763 | A | * | 12/1985 | Bode et al. | 53/527 |
| 4,642,971 | A | * | 2/1987 | Gilkey | 53/435 |
| 4,646,509 | A | * | 3/1987 | Tribert | 53/446 |
| 5,121,591 | A | | 6/1992 | Backus et al. | |
| 6,079,191 | A | | 6/2000 | Borkiewicz et al. | |

* cited by examiner

*Primary Examiner* — Christopher Harmon
(74) *Attorney, Agent, or Firm* — Lando & Anastasi, LLP

(57) ABSTRACT

A padding machine for packaging substantial products, particularly cucumbers, comprising, on a supporting frame, a carousel assembly for the advancement of containers, the machine further comprising, on the carousel assembly, at each container, a positioning pad for centering the products that overflow laterally from the mouth of the container and a packing pad for inserting the products in the container.

6 Claims, 6 Drawing Sheets

PADDING MACHINE FOR PACKAGING SUBSTANTIAL PRODUCTS, PARTIALLY CUCUMBERS AND THE LIKE

TECHNICAL FIELD

The present invention relates to a padding machine for packaging substantial products, particularly cucumbers and the like.

BACKGROUND ART

As is known, in the food packaging industry the need is felt to package products that sometimes are rather substantial, such as for example cucumbers, without damaging the product, for example by shearing it.

Currently, cucumbers and the like are packaged in many cases manually so as to pack the cucumbers that protrude from the upper portion of the container, so as to arrange them correctly; it is obvious that this method causes a significant expenditure of workforce.

To try to solve the problem, machines have already been provided in which there are, in practice, guides that have to arrange the product with respect to the mouth of the container, after which the packing pad is made to descend.

However, in these embodiments the product is not always positioned correctly in the container, and therefore the packing pad can both shear the product, which is not appreciated by the consumer, or can break the container if it is made of glass, with the need to stop the machine and proceed with the cleaning.

DISCLOSURE OF THE INVENTION

The aim of the invention is to eliminate the drawbacks noted above, by providing a padding machine for packaging substantial products, particularly cucumbers and the like, that allows to provide a precise positioning of the product that overflows with respect to the container, so that it is possible to perform packing without damaging or shearing of the product and without breaking the glass container.

Within this aim, an object of the invention is to provide a padding machine in which it is possible to recover automatically all the overflowing substantial products, optimizing all packaging steps.

Another object of the present invention is to provide a padding machine that thanks to its particular constructive characteristics is capable of giving the greatest assurances of reliability and safety in use.

Still another object of the present invention is to provide a padding machine for packaging substantial products, particularly cucumbers and the like, that can be easily obtained starting from commonly commercially available elements and materials and is also competitive from a merely economical standpoint.

This aim and these and other objects which will become better apparent hereinafter are achieved by a padding machine for packaging substantial products, particularly cucumbers and the like, comprising, on a supporting frame, a carousel assembly for the advancement of containers and the like, characterized in that it comprises, on said carousel assembly, at each container, a positioning pad for centering the products that overflow laterally from the mouth of the container and a packing pad for introducing said products in said container.

BRIEF DESCRIPTION OF THE DRAWINGS

Further characteristics and advantages of the present invention will become better apparent from the description of a preferred but not exclusive embodiment of a padding machine for packaging substantial products, particularly cucumbers and the like, illustrated by way of non-limiting example in the accompanying drawings, wherein.

WAYS OF CARRYING OUT THE INVENTION

Figure 1:
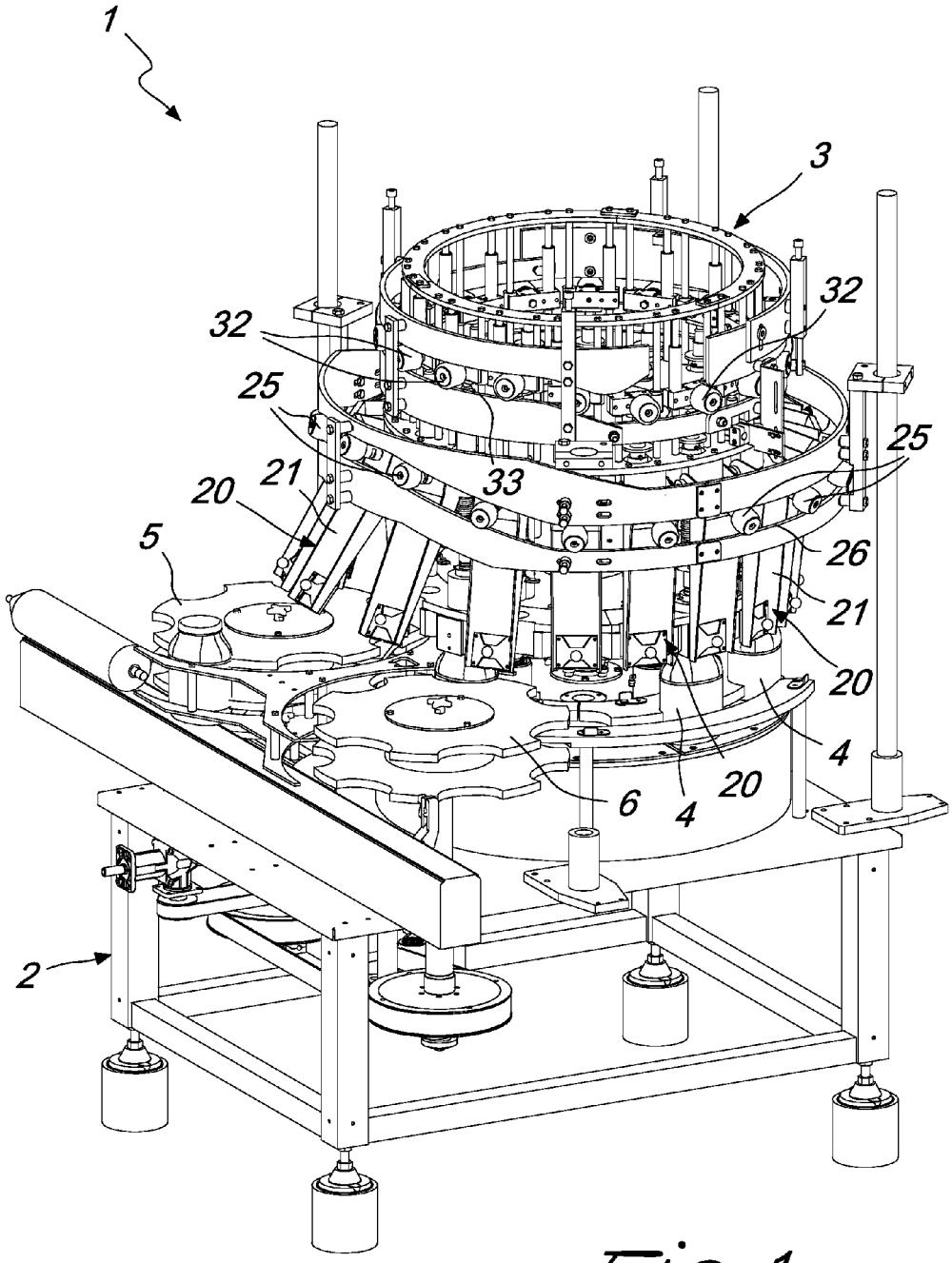
FIG. 1 is a schematic perspective view of the padding machine.
Figure 2:
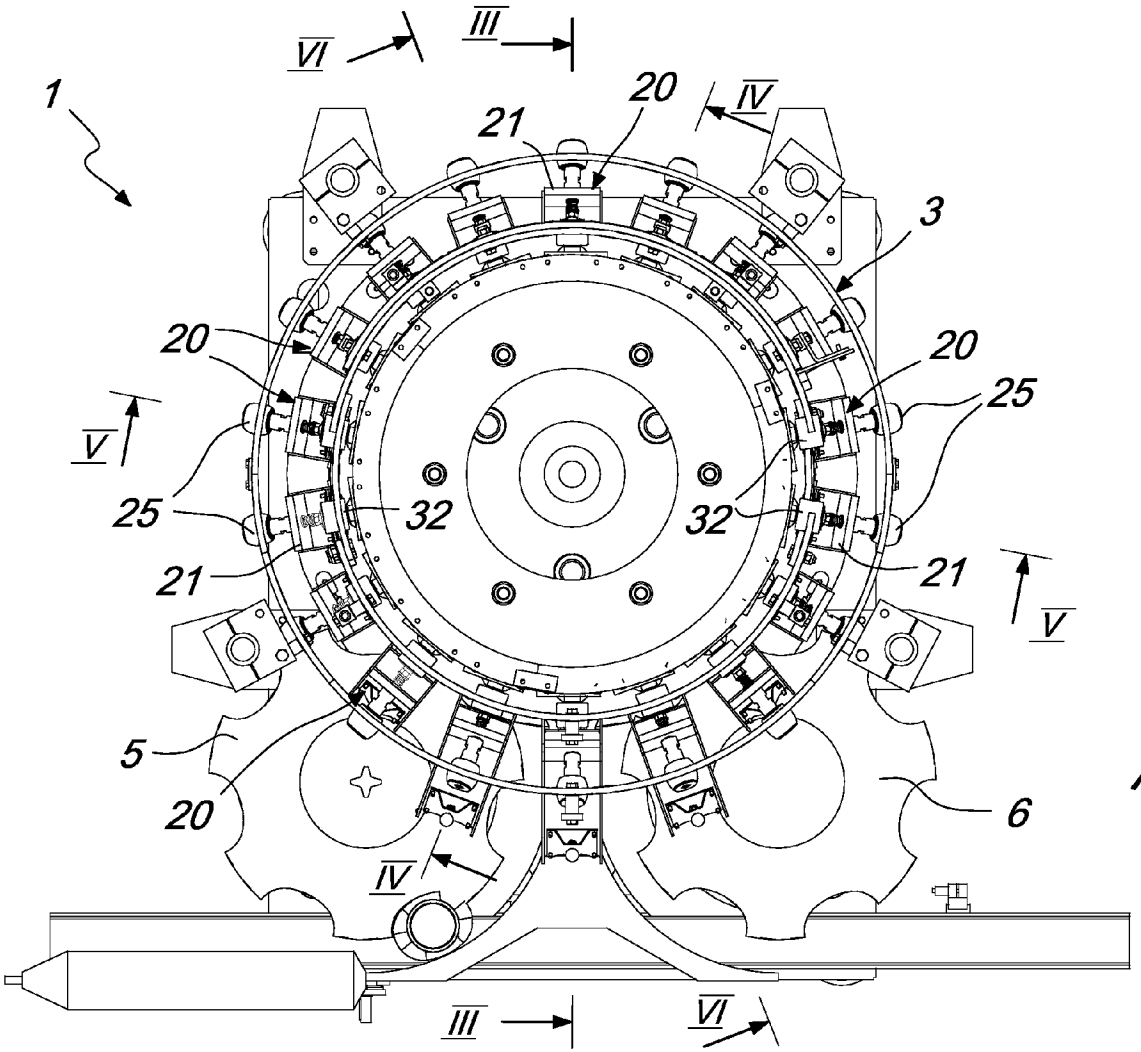
FIG. 2 is a plan view of the padding machine.
Figure 3:
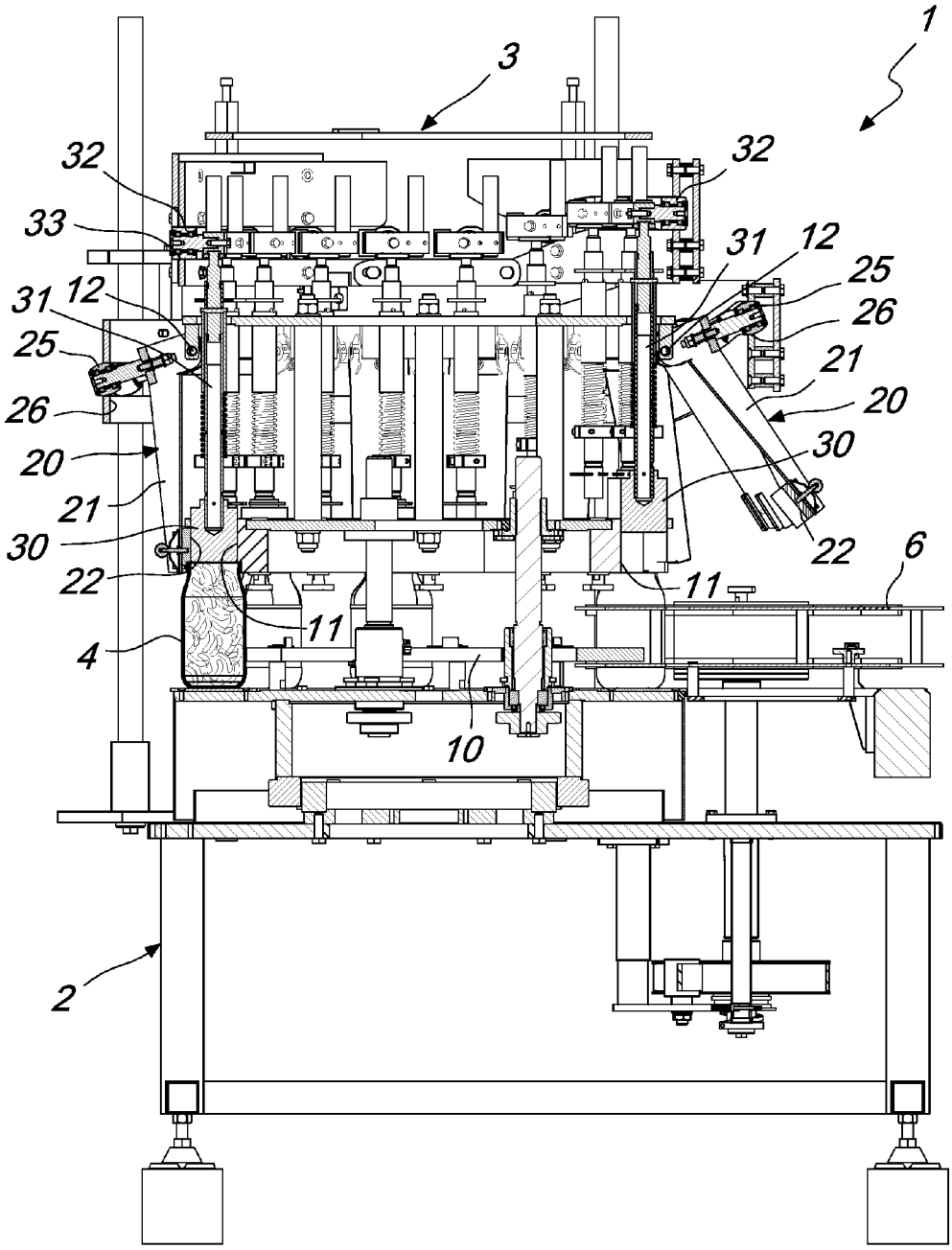
FIG. 3 is a sectional view of the padding machine, taken along the line III-III of FIG. 2.
Figure 4:
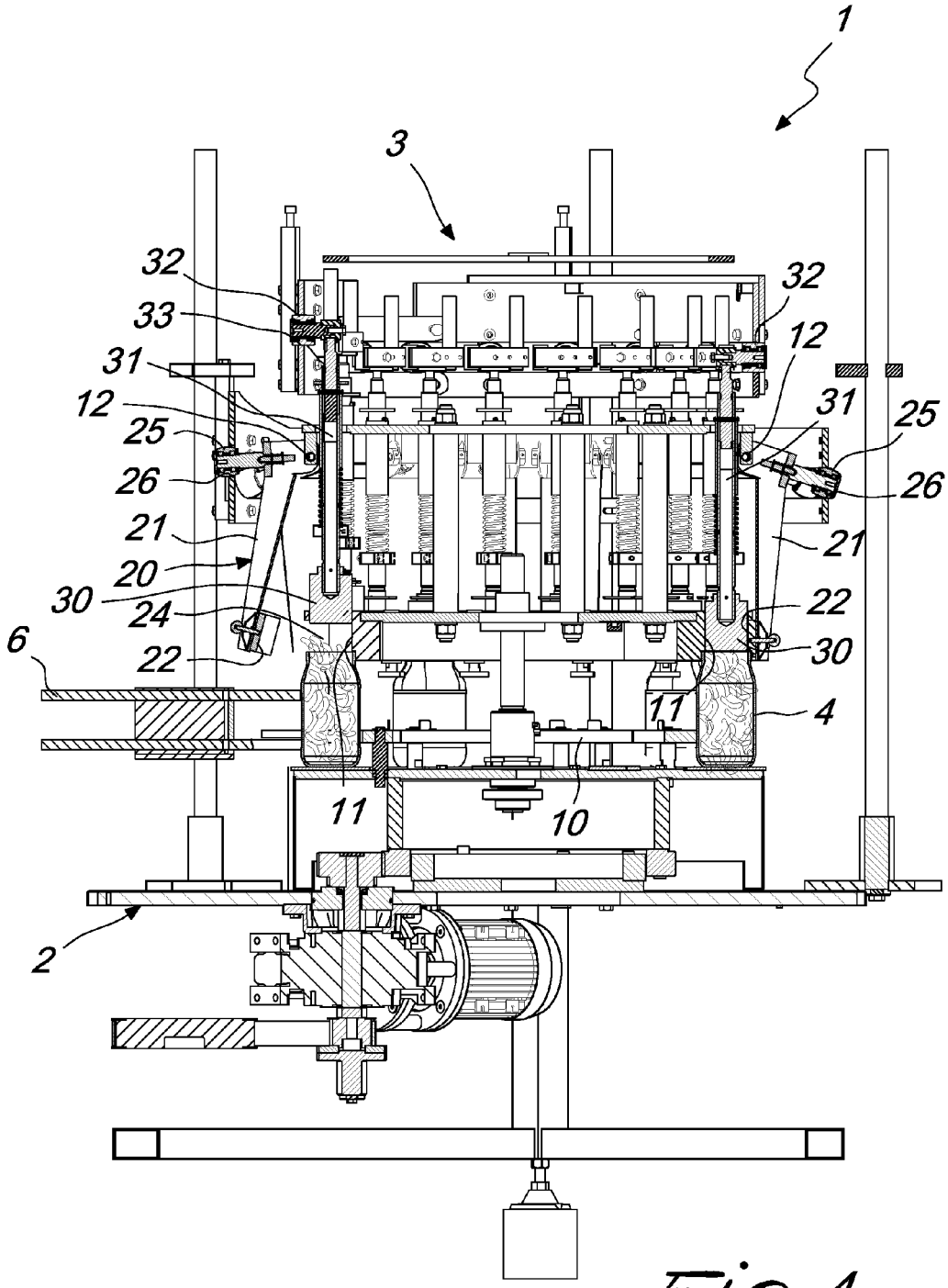
FIG. 4 is a sectional view of the padding machine, taken along the line IV-IV of FIG. 2.
Figure 5:
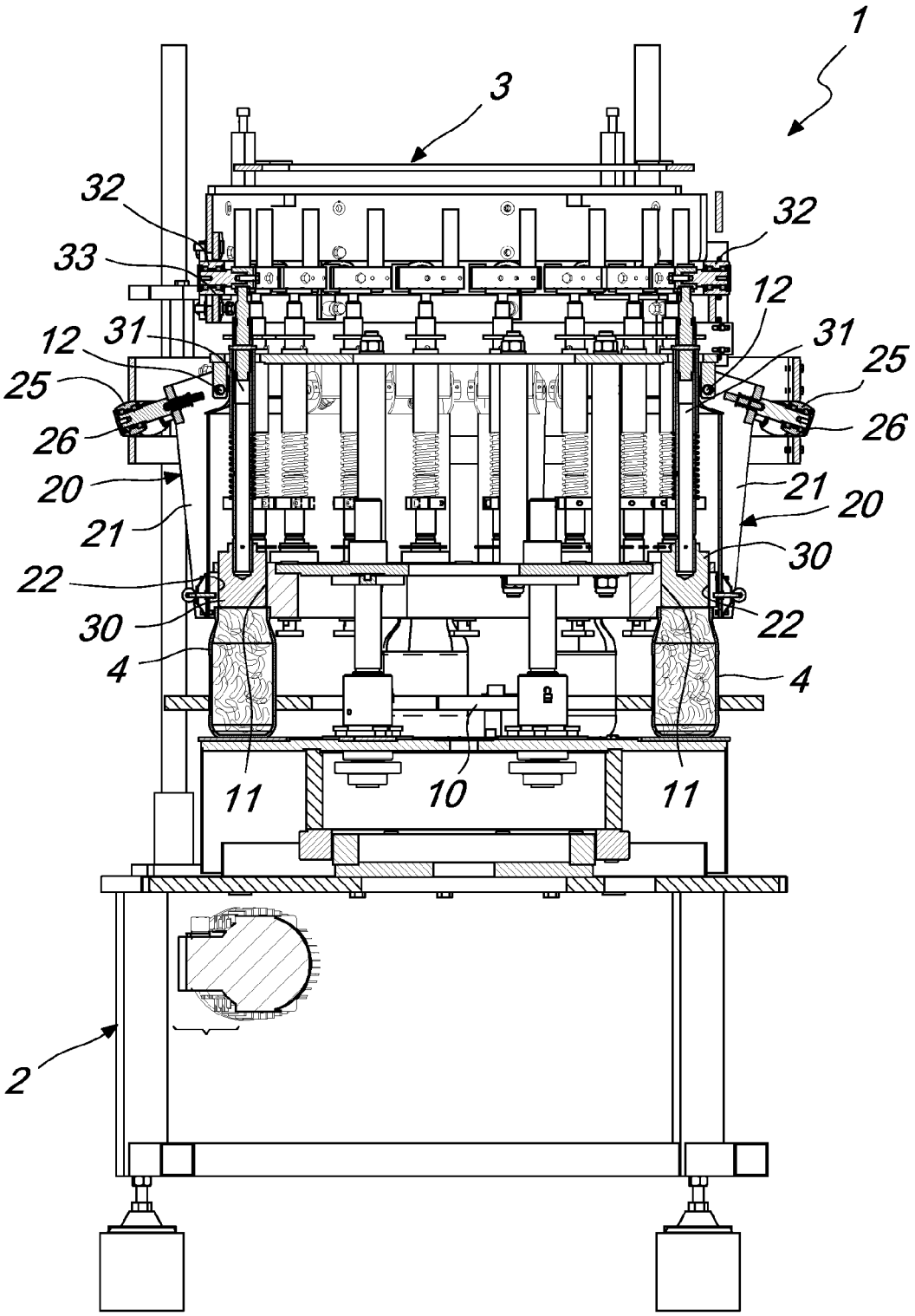
FIG. 5 is a sectional view of the padding machine, taken along the line V-V of FIG. 2.
Figure 6:
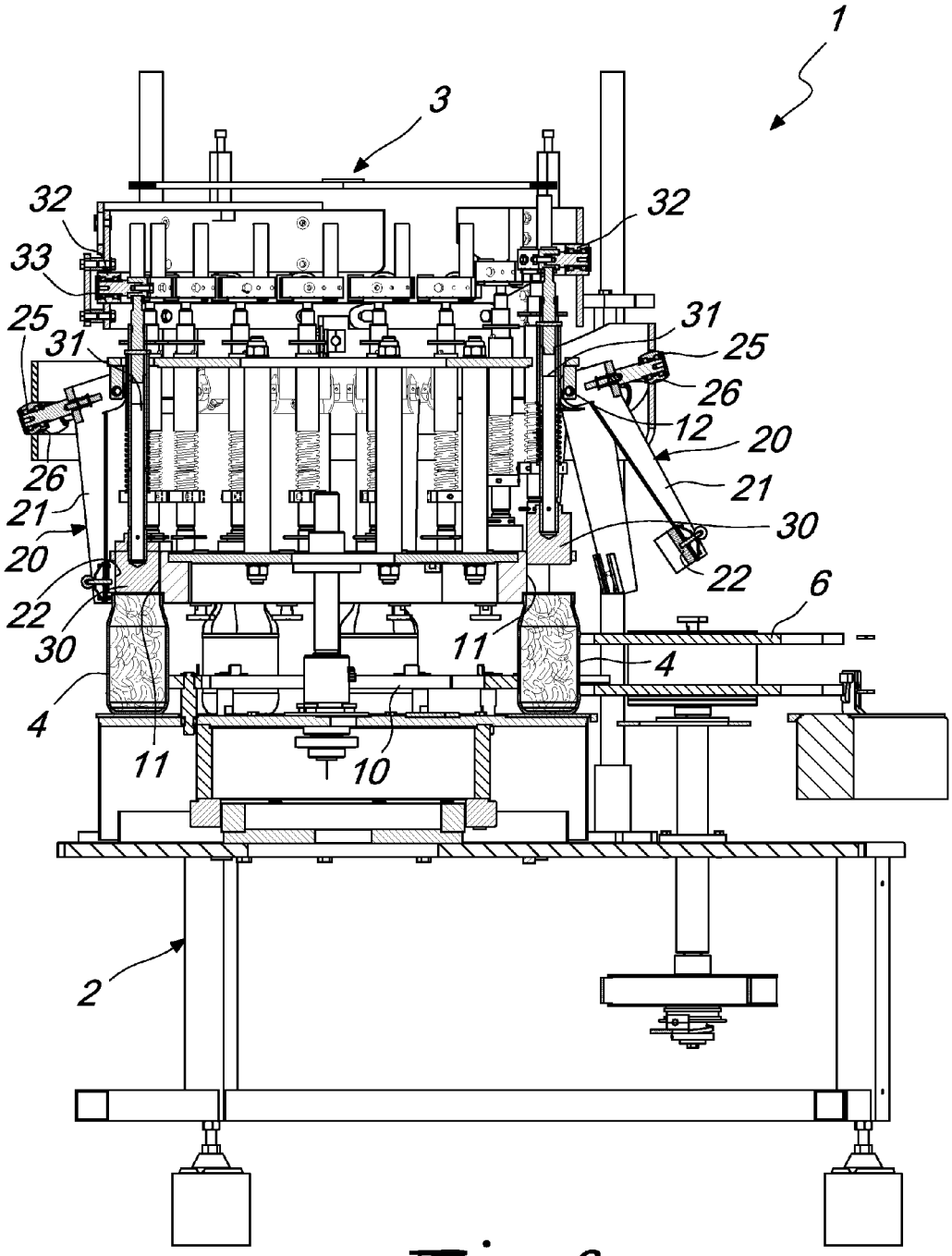
FIG. 6 is a sectional view of the padding machine, taken along the line VI-VI of FIG. 2.

With reference to the figures, the padding machine for packaging substantial products, particularly cucumbers and the like, generally designated by the reference numeral 1, comprises a supporting frame 2, which is usually interposed on the advancement line of containers in which the product to be packaged has been introduced, such product being typically a substantial product, such as for example cucumbers and the like, which are usually arranged according to the preset weight and must be packed inside the container.

A carousel assembly 3 is provided on the frame 2 for the advancement, along a circular path, of containers 4, which are introduced by means of an insertion wheel 5 and are made to exit by means of an extraction wheel 6, which is arranged opposite the end of the path around the carousel.

One of the peculiarities of the machine according to the invention resides in that at each container, which is accommodated on a circular rack 10, a positioning seat 11 is provided, which is open outwardly.

A positioning pad, generally designated by the reference numeral 20, is arranged at each container accommodated in the open seat 11, and has a lever arm 21 that supports, at one end, a completion element 22 which, by mating with the seat 11, defines in practice a chamber 24 whose dimensions correspond to the mouth of the underlying container 4.

At the other end, with respect to the pivoting point 12 of the levers 21, a cam follower roller 25 is provided, which follows a lower cam-like path 26 so that during the rotation of the carousel the pads in the initial step of insertion of the containers are made to move closer to the containers so that the completion element 22, by mating with the seat 11, defines the chamber 24, in practice centering the contained products that protruded with respect to the mouth.

A packing pad, designated by the reference numeral 30, is provided at each container and is made to perform a vertical translational motion so as to insert the product in the container, passing in practice in the chamber 24 defined between the seat 11 and the completion element 22; in this manner, a precise guide for the packing pad 30 is provided, avoiding the risk of breakage of the glass container, with the associated machine downtime for cleaning.

The pads 30 are supported by sliding rods 31, which have upper cam following rollers 32 that are made to slide within an upper circular cam 33, so as to perform insertion after the positioning pad has defined the chamber 24 above the container.

In practical operation, the machine continuously centers the product by means of the positioning pads, which in practice are made to oscillate to move adjacent to the container, and then insertion for packing the product by means of the packing pad is performed.

Once the packaging step has ended, the packing pad is made to rise again and the positioning pad is moved outwardly again to allow the removal of the container in which the product has been introduced.

From what has been described above it can be seen that the machine according to the invention achieves the proposed aim and objects, and in particular the fact is stressed that the presence of the positioning pad allows to arrange the products above the container so that in its subsequent descent the packing pad cannot shear the products, since it can create a chamber whose diameter is equal to, or possibly smaller than, the diameter of the mouth of the container.

The invention thus conceived is susceptible of numerous modifications and variations, all of which are within the scope of the appended claims.

All the details may further be replaced with other technically equivalent elements.

In practice, the materials used, so long as they are compatible with the specific use, as well as the contingent shapes and dimensions, may be any according to requirements.

The disclosures in Italian Patent Application No. MI2008A001257 from which this application claims priority are incorporated herein by reference.

The invention claimed is:

1. A padding machine for packaging substantial products, particularly cucumbers and the like, comprising, on a supporting frame, a carousel assembly for the advancement of containers, further comprising, on said carousel assembly, at each container, a positioning pad for centering the products that overflow laterally from the mouth of the container and a packing pad for introducing said products in said containers, said carousel assembly comprising, at each container, an open seat, which can be arranged laterally adjacent to the mouth of said container, each positioning pad supporting a completion element, which can be coupled to said open seat to define a chamber above the mouth of said container.

2. The padding machine according to claim 1, wherein said chamber has a diameter which is equal to, or smaller than, the diameter of said mouth of the container.

3. The padding machine according to claim 1, wherein each positioning pad comprises a lever arm, which is pivoted to said carousel assembly and supports said completion element at one end and a cam follower roller at the other end.

4. The padding machine according to claim 3, wherein said carousel assembly defines a lower cam path, which can be engaged by said cam follower rollers of said lever arms.

5. The padding machine according to claim 1, wherein each of said packing pads is supported by a rod, which can slide vertically with respect to said container, said packing pad being insertable in said chamber.

6. The padding machine according to claim 5, further comprising upper cam follower rollers, which are associated with said sliding rods and can engage an upper circular cam formed by said carousel assembly.

* * * * *